US005792317A

United States Patent [19]

Taylor et al.

[11] Patent Number: 5,792,317

[45] Date of Patent: Aug. 11, 1998

[54] WET END STARCH APPLICATION

[75] Inventors: John Andrew Taylor, Baldwinsville; Marcus Francis Foulger; Joseph Edgar Parisian, III, both of Watertown, all of N.Y.; Hanuman Prasad Didwania, Lisle, Ill.

[73] Assignees: GL&V-Paper Machine Group, Inc., Quebec, Canada; Jefferson Smurfit Corporation, Clayton, Mo.

[21] Appl. No.: 597,828

[22] Filed: Feb. 7, 1996

[51] Int. Cl.[6] ..... D21H 23/28

[52] U.S. Cl. ..... 162/175; 162/183; 162/186

[58] Field of Search ..... 162/175, 184, 162/185, 186, 266, 183

[56] References Cited

U.S. PATENT DOCUMENTS

| | | | |
|---|---|---|---|
| 874,946 | 12/1907 | Eichorn et al. | 162/266 |
| 1,538,582 | 5/1925 | Olander et al. | 162/266 |
| 1,903,236 | 3/1933 | Johnsen | 162/186 |
| 2,373,914 | 4/1945 | Quinn | 162/186 |
| 3,919,042 | 11/1975 | Spiller | 162/175 |
| 3,992,252 | 11/1976 | Coleman | 162/266 |
| 4,093,016 | 6/1978 | Coleman | 162/186 |
| 4,342,423 | 8/1982 | Coleman | 239/1 |
| 4,355,762 | 10/1982 | Coleman | 239/193 |
| 5,149,341 | 9/1992 | Taylor et al. | 55/36 |
| 5,433,826 | 7/1995 | Glomb et al. | 162/175 |

FOREIGN PATENT DOCUMENTS

| | | | |
|---|---|---|---|
| 704036 | 2/1965 | Canada | 162/186 |
| 2719204 | 8/1978 | Germany | 162/186 |

*Primary Examiner*—Peter Chin

*Attorney, Agent, or Firm*—Biebel & French

[57] ABSTRACT

A method of applying a starch sizing to a forming web on a paper machine, such as in the form of a curtain on a fourdrinier machine, employs a suspension of uncooked particulate starch and water which is applied, as a suspension, to the inlet of a downwardly opening die positioned over the forming web and applied at a consistency of between about 2 to 10% onto the surface of the web as a free falling curtain, the impact velocity of which is controlled to a rate sufficiently low to prevent distortion of the web on impact. Improved drainage is achieved by heating the suspension to a temperature less than about 150°, to prevent the cooking of the starched particles. The curtain may be applied to the web at fourdrinier table consistencies as low as about 2% and still obtain starch retention rates of about 80%.

14 Claims, 4 Drawing Sheets

WET END STARCH APPLICATION

This invention is directed to the application of a water material, such as suspension of starch in water to a traveling newly-formed web of paper on a paper making machine.

BACKGROUND OF THE INVENTION

Subject matter of this invention relates to the application of suspended particulate matter to a newly formed web of paper in such as manner that the suspended material is captured or deposited within the fibers of the sheet such that a high percentage of the particulate matter, upwards of 50% or more, is retained within the web. The invention is particularly suited for the application of a sizing starch to a web, and provides an apparatus and method which can take the place of the conventional sizing press, although other kinds of matter may be applied, or combined with starch.

Sizing in the form of starch has commonly been applied to newly formed paper webs to enhance the mechanical properties of the paper. Particularly, starch has been found to have a significant impact on sheet strength properties, including tensile strength, stiffness, resistance against edgewise compression, and pick resistance. Starch can increase compressive strengths by about 25%. Commonly, starch solutions are applied by a size press, although other arrangements have been used.

Starch has also been applied, in various other manners, to a newly formed web at the so-called wet end of a paper machine. The prior art includes references which teach the direct application of a cooked starch solution to a newly-formed web on a wire of a fourdrinier machine. The early references of Olander et al., U.S. Pat. No. 1,538,582 of May 19, 1925 and Johnsen, U.S. Pat. No. 1,903,326 of Mar. 28, 1933 apply a sizing solution to an upper surface of a web by an overflow applicator. A more recent example of a starch application is the wet end curtain coater of Coleman, U.S. Pat. No. 3,992,252 issued Nov. 16, 1976.

Generally, the application of a starch solution by an overflow applicator at the wet end of a paper machine has not been widely practiced. The amount of starch which can be added is often insufficient to provide the desired properties to the finished paper. It also has been observed that cooked starch interferes with water drainage of the web on the wire.

The principal means of adding starch is by a conventional size press. Size presses are commonly used after a first dryer section, and have the capability of applying starch in typical pickup ranges from 40 lbs. per ton to 100 lbs. per ton or more. However, such installations suffer the disadvantages in the high cost of the size press and in the costs associated with the additional dryer sections and heat energy required downstream of the size press.

Another method of applying starch is to add the solution with the paper pulp stock prior to or at the headbox. Commonly, cationic cooked starch is used. About 35 lbs. of starch per ton of paper has been the practical upper limit for retention in the sheet. Since the starch is in solution, some of it drains out with the white water and, eventually, the white water loop will fill up with starch. This is one of the reasons why the amount of starch which can be added in a headbox has a practical limit. Also, where the starch is in solution, the paper fibers have a minimum filtering effect on the starch which would otherwise tend to retain the starch and for that reason, cationic attraction has been used to improve retention. However, ionic trash tends to neutralize the starch's cationic charge and reduces retention.

In other instances, particularly in the manufacture of multi-ply board on cylinder machines, spray bars have been used to apply a starch solution directly on the wet stock. Spray bar arrangements are not widely used at wet ends of paper machines due to the poor appearance of the paper by reason of a non-uniformity of the starch application.

Dry electrostically charged starch particles have been deposited on the surface of a web, while the web is on the wire of a fourdrinier machine, as described in the Spiller U.S. Pat. No. 3,919,042 issued Nov. 11, 1975. Spiller teaches that such electrostatically charged particles of dry starch may be applied at relatively light weights (1–3% starch on the basis of fiber weight, i.e., 20–90 lbs. per ton). Also, Spiller teaches that the dry starch will, to some extent, be hydrated by moisture in the web and will be cooked as the web passes through the high temperature dryer section of the paper machine.

Attempts to add wet materials to an upper exposed surface of a newly formed and draining web of paper, such as on a wire of a fourdrinier machine, have suffered due to the lack of satisfactory application apparatus and methods. Starches have been applied variously by apparatus which allows a starch solution to fall along the surface a lip or wall, as a curtain and continue to the web. However, starch can build up on the applicator surfaces and result in uneven distribution and application of the material, or can form skips in the coating.

It is known that the application of heat to a film or curtain improves the ability of the suction boxes to remove the water content of the web, but inadequate attention has been paid to apparatus for permitting the application of heat to the coating material and at the same time preventing the coater parts lips from accumulating coating material that interferes with the uniform application of the coating.

SUMMARY OF THE INVENTION

Applicants have discovered that a high quantity suspended particulate matter, such as particles of uncooked starch, can effectively be applied at the wet end of the paper machine as a suspension in water. Since uncooked starch occupies a much smaller volume than cooked starch, it is possible to apply a high quantity of uncooked starch in finely granular or solid form, onto an exposed surface of a newly formed web while retaining, in the web, a high percentage the starch particles and while having a relatively low loading of particles-to-water content. Thus, relatively substantial quantities of starch, by weight, can be applied at reasonably low consistencies of about 10% or less down to as low as about 2% or less. The starch suspension may be applied to a web on a fourdrinier wire at table consistencies as low as about 2% or less.

Uncooked starch is fine particulate material, approximately 25 micrometers in size. When mixed with water at a temperature less than about 150° F., a starch suspension is formed which will tend to increase somewhat in bulk and will absorb a certain amount of water, generally an amount approximating the weight of the dry starch. However, if the temperature is elevated in excess of about 150° F., the starch granule expands enormously, in the range of about 10 to 100 times its volume, depending on the type of starch. Due to this inherent bulking which occurs when starches are placed in solution by heating, the uniform application of a sufficient quantity of starch by a curtain type coater becomes much more difficult, and is substantially simplified by the application of a suspension of uncooked starch particles.

The invention includes the application of a water dispersion of uncooked starch to an exposed surface of a forming web, such as while the web is carried on a foraminous wire. A curtain of dispersed uncooked starch particles suspended in water moves through a die slot and falls from a lip land at a controlled rate to provide a landing velocity against the web which is not so low that entrained air carried by the surface of the stock can deflect the curtain and cause skips, and is not so high as to cause deformation or disruption of the web by the curtain. Preferably, a wind shield is positioned on one side or the other of the curtain to extend the operating range at the low velocity end.

By controlling the landing velocity in relation to the machine speed of the wire, and by controlling the flow rate and the consistency of the suspension, and eliminating any entrained bubbles which would cause skips in the coating, it has been found possible to apply a uniform sizing at a rate in excess of 100 pounds of starch/ton of paper (dry). The suspended particles are retained to a large extent by mechanical entrapment in the paper fibers and displace a certain amount of the water content of the web.

Since uncooked starch is, itself, somewhat hygroscopic and absorbs its weight in water, but does not appreciably expand, and since the particles are fully wetted on all surfaces, they are readily hydrated and activated with the remaining water in the sheet, by the heat in the dryer section. It is observed that complete hydration occurs in the dryer section and therefore improved bonding results between the paper fibers and at higher starch application rates than can be achieved with prior on-wire cooked starch application methods or dry application methods.

The coating apparatus is preferably one which creates a stream at a specific flowrate and velocity, by a downwardly opening slot-type extruder. Where a slotted extruder die is employed, air bubbles in the sizing which could bridge the slot are removed to prevent a skip.

The 0.001" air bubbles resulting from the act of making a dispersion can break the curtain when the curtain thins out due to acceleration. This can be 5 to 8 inches below the die lips. These bubbles must be removed prior to entering the die.

It is possible to run the die in either a jet or curtain coater mode. In the curtain coater mode the slot velocity is below 230 feet per minute, the exterior of the lips are wetted horizontally forming dead pools of fluid which become dry at the metal-to-liquid interface and distort the flow. In the jet mode the lips are not wetted but drying can still occur at the metal-to-liquid interface, causing distortion of the flow.

The die is a preferably through-flow design in that a starch suspension is brought in at one end while some of the suspension is bled out the other end. An offset die passageway permits the die body to be made without end plates. The dimensions of the flow through passageway and the rate of flow are sufficient to maintain a turbulent flow condition to assure that the starch remains in suspension and does not settle out. Preferably, the through flow passage is reduced in size between the inlet at one end of the die and the outlet at the other end for the purpose of maintaining approximately the same velocity of flow with decreasing flow volume.

In the preferred embodiment of the apparatus for this invention, it has been found advantageous to provide an extrusion-type die and with a starch suspension which is preheated prior to application to the web. A heated suspension, below the temperature of rapid particle swelling, aids in drainage of the water from the suspension and from the stock on the wire after application to the web. The heated suspension acts to heat the water content of the web over the suction boxes on the fourdrinier machine and by decreases the viscosity of the liquid content, an increased rate of water or liquid removal is possible through the suction boxes. Substantially all of the water content of the suspension may be removed without appreciably increasing the wetness of the web downstream of the point of application.

Cleanliness of the die lips is improved by chilling the die lips immediately at the die exit orifice to a temperature such as to cause water vapor to condense on the die lips. This condensation provides a wetted surface which resists the attachment of starch thereto and flushes the die lips surfaces so that they remain clean and unobstructed.

The process and apparatus according to this invention can eliminate the need for a conventional size press and thus save considerable expense. Particularly, the use of the invention can allow a paper machine to make paper having size-pressed properties where the space and cost of a conventional size press cannot be justified. The efficiency of the starch application in this manner at an increase temperature, particularly using uncooked starch particles, does not add significantly to the burden of water removal on a fourdrinier wire. The water added by the curtain displaces some of the liquid content already in the newly formed web and is picked up by the conventional foils or suction boxes beneath the wire. Therefore, a minimum of adjustment to the de-watering equipment on the wire need be made in order to remove the water added by the application process, in order to maintain the consistency at the couch roll and to maintain the necessary consistency at the end of the press section. When applying starch, the maximum application temperature should not exceed about 150° F.

Particularly effective die and delivery system are disclosed for the purpose of creating a downwardly falling curtain, as an applicator of particles in suspension to an exposed upper surface of a newly formed web, such as on a fourdrinier machine. The die and the delivery system for pumping the suspension to the die, maintain a turbulent flow condition to prevent settling or separation of the particles from the suspension.

The die, in some respects, resembles a plastic extrusion die in that an extrusion slot is formed between the facing lands of a pair of die halves. The slot opens at a downwardly facing exit orifice between a pair of die lips. The extrusion slot is feed from a main supply channel which runs longitudinally through the die with an inlet at one end of the die and an outlet at the other end of the die. Chilled water or other cooling fluids may be run through passageways or conduits closely associated with the die lips so that the die lips are chilled preferably below the dew point of the air in the immediate environment. In this manner, the die lips are sufficiently cooled as to cause moisture to condense on the die lips, thereby prewetting the die lips.

Preferably, one of the die lips, such as the upstream die lip, is downwardly offset from the other die lip to form a final curtain-forming land, with the result that the suspension flows through the die slot and past the end of the shorter die lip, along the surface of the longer die lip and departs from a lower abrupt edge of the longer die lip and then falls, as a curtain, to the surface of the web.

The die lip extension, in a curtain coater, provides stability to the curtain. First, by carrying the film beyond one of the die lips along a planar surface, the eddy currents which will form at the terminus of the die lip, are isolated with respect to the shorter die lip and the film is provided a short space in which to stabilize along the land of the longer die lip. This transition from two confining surfaces to one surface permits the surface tension to flatten and stabilize the flow at the region of extension, and further reduces friction to the flow, by eliminating one surface. Accordingly, the flow may begin to accelerate immediately before the falling curtain of material is formed.

In some instances, a wind curtain, which extends transversely of the web and adjacent and parallel to the curtain, may be used to protect the curtain and to extend the low velocity flow range.

The through passage, extending longitudinally of the die and the major portion of the length of the die, is formed by mating recesses formed in each die half, at the parting plane, and at the extrusion slot. However, as the passageway approaches the die ends, the passageway is offset at the die ends so that the entrance and exit positions are formed in one die body only. In this manner, a tight plumbing connection may be made with the die body for feeding the suspension to the passageway at one end and for removing the through-flow suspension from the other end, with the elimination of the need for the usual die body end plates.

The delivery system provides a suspension flow to the die body which includes a heater for pre-heating the suspension to a predetermined temperature, in the case of uncooked starch, to about 150° F. Also, the suspension is delivered substantially free of entrained air bubbles which could bridge across the extrusion slot defined by the die lands and cause skips or aberrations. Preferably, a vibrating filter is placed in line ahead of the die body to remove objectionably large particles which would or could cause a blockage of the die slot.

The transverse width of the extrusion slot is not critical as long as it equals or exceeds the width of the web on the fourdrinier wire. Where the width of the die lip slot exceeds the web, the overrun material is collected and returned to the supply.

While the apparatus and system as disclosed in this invention is particularly adapted to the handling and application of an uncooked starch suspension, it is within the scope of the invention to use such apparatus and system to add other mechanically or chemically suspended mixtures or colloidal mixtures, where a product or substance is desired to be added to a product on a fourdrinier wire. These can include a wet milled cornstarch or organic compounds or organic or inorganic pigments including solids in suspension or in solution, as required.

It is therefore an important object of the invention to provide a method for applying starch or other particles directly to the web on the wire of the wet end of a paper machine, such as a fourdrinier machine.

A further object of the invention is to provide a method for applying uncooked starch to a newly formed web of paper.

A still further object of the invention is the provision of a method for applying uncooked starch using a curtain coater die and providing a landing velocity which is sufficiently low to prevent web distortion and sufficiently high to prevent deflection caused by entrained air.

Another important object of the invention is the provision of a starch application method, as outlined above, in which higher quantities of starch may be applied as a suspension in water, in which the starch is not cooked thereby permitting a higher quantity of starch to be applied to the web than possible when applying a cooked starch solution to the web. In this method, advantage is taken of the fact that the starch particles will absorb certain quantities of moisture which are carried into the dryer section and which assist in the hydration of the starch particles and the bonding of the starch molecules to the paper stock fibers.

Another object of the invention is the provision of application apparatus or system for the practice of the above-defined method particularly for forming a downwardly moving wall or curtain of a suspension of uncooked starch and water for application to a moving web.

A more particular object is the provision of a die in which the die lips are chilled to form condensate on the die lips to resist wetting by the starch particles.

Another object is the provision of an application system as outlined above in which a vibrating filter is placed ahead of application die to remove particles and dirt which could plug the die slot.

Other objects and advantages of the invention will be apparent from the following description, the accompanying drawings and the appended claims.

DESCRIPTION OF THE PREFERRED EMBODIMENT

Figure 1:
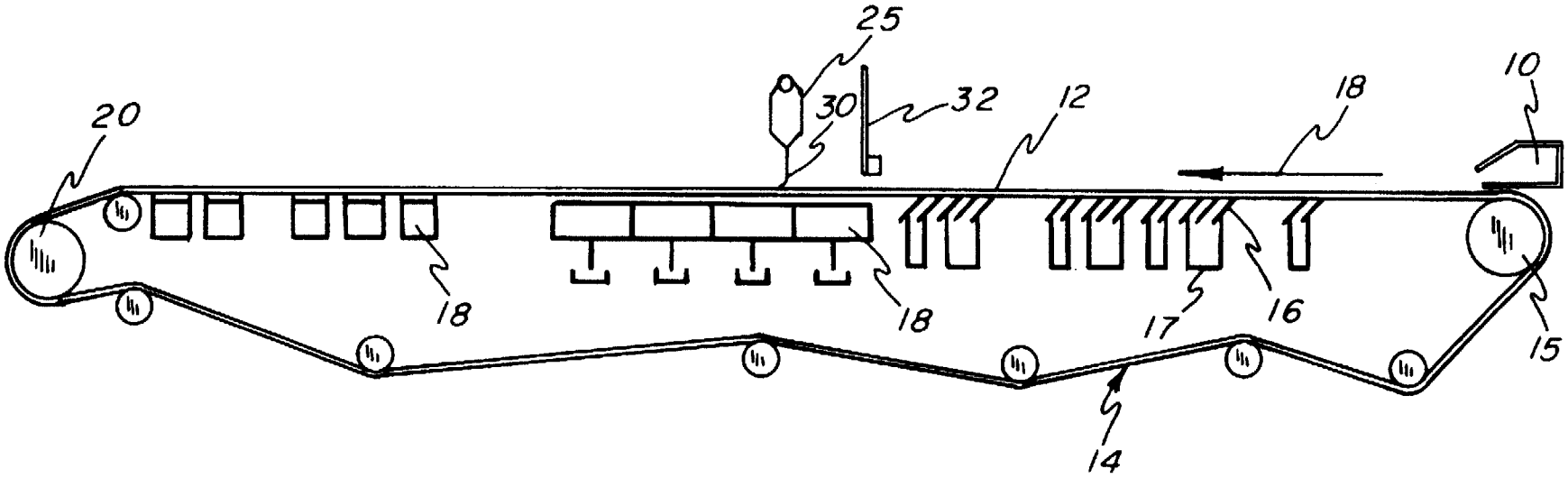
FIG. 1 is a diagrammatic side elevation of the forming wire portion of a fourdrinier machine showing the curtain coater die and wind curtain in approximate relation to the exposed surface of the forming wire.

Referring to FIG. 1, the table portion of a fourdrinier machine to which the invention may be applied is diagrammatically illustrated, in which a headbox 10 conventionally applies a dilute slurry of paper making stock to the exposed upper surface 12 of an endless fourdrinier wire 14 at a breast roll 15. The stock suspension is drained through the wire 14, aided by one or more of a plurality of deflection foils 16 leading into boxes 17, and one or more suction boxes 18, all of which are positioned under the table and having open tops over which the wire 14 runs. In a typical case, the stock slurry or suspension is applied by the headbox 10 onto the surface of the wire 14, moving in the direction of the arrow 18 with an initial consistency of less than 1%, solids to liquid. Immediately upon being applied to the fourdrinier wire, the fibers of the paper stock suspension form or begin to form a web on the exposed upper surface of the wire 14 as the white water is drained from the fibers and through the wire by the foils as augmented by suction boxes.

The fourdrinier table is known as the "wet end" of a paper making machine, and while the pulp suspension from the headbox 10 may hit the wire at the breast roll at a consistency less than about 1%, by the time the web reaches the couch roll 20, the table consistency may be as high as 25%. It is therefore understood that a major portion of the original water content of the stock suspension is removed in the fourdrinier machine along the length of the wire 14.

FIG. 1 also diagrammatically illustrates a curtain coater die body or applicator 25 which, is understood, to extend transversely the width of the wire 14 or even somewhat beyond. The die applicator forms a falling curtain 30 of a liquid suspension of material which is added to or applied to the exposed upper surface of the fibers formed on the wire 14. A wind curtain 32 is shown as positioned adjacent the curtain coater die body 25 and preferably immediately upstream of the curtain 30 to assist in deflecting the movement of air which may be entrained by the rapidly moving wire 14, which air movement would tend to disrupt the curtain 30.

An improved die type applicator for applying a starch suspension, as a curtain, is illustrated in FIGS. 2–5. A support tube 40 extends in a cross machine direction above the wire 14, and the die body 25 hangs from the tube 40 on brackets 42. The die body 25 extends the full width of the wire 14 and somewhat beyond, so that the die slot defined by the body 25 can apply a curtain 30 across the full width of the wire, as needed.

The body of the die 25 has many similarities in common to that of a flat film extruder, and is formed in two mating die body portions including a front die body portion 46 and a rear die body portion 48. The die body 25, and each of the die portions 46 and 48, have first and second ends defining the opposite ends of the die body, such as the common inlet end 25*a* formed at one end and the outlet end 25*b* formed at the other end.

Figure 5:
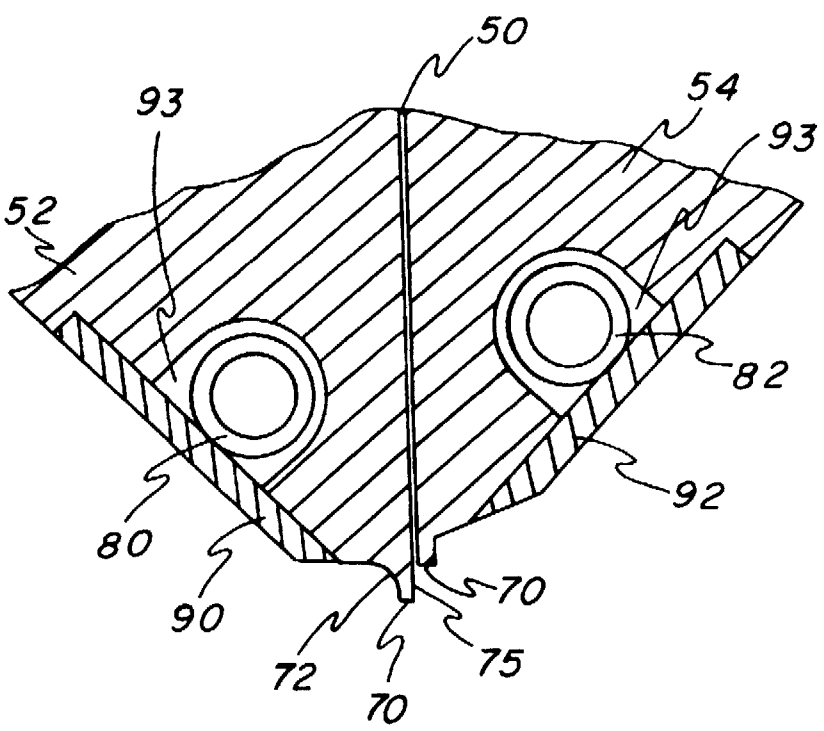
FIG. 5 is an enlarged fragmentary sectional view through the die body portions showing the feed slot and the die lips, and illustrating the cooling passageways extending longitudinally of the die lips.
Figure 4:
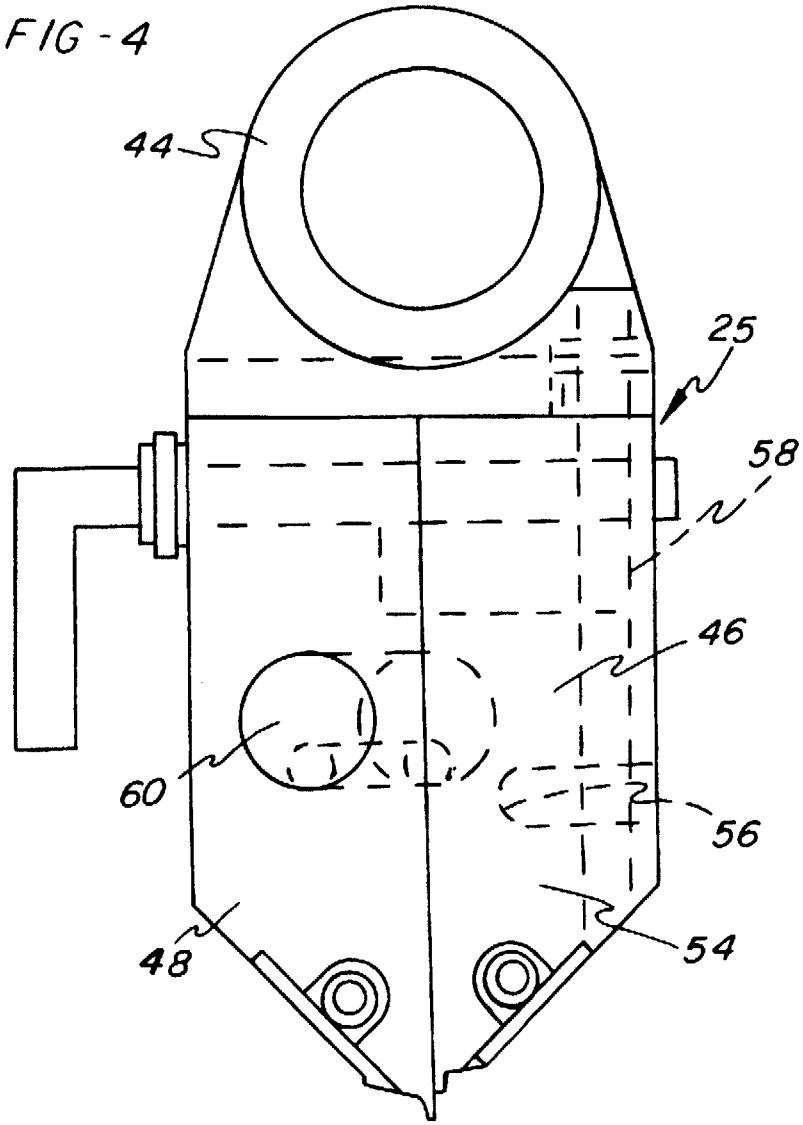
FIG. 4 is an elevational view looking at one of the ends of the die body of FIG. 2.

Each of the die body portions 46 and 48 are formed, along a lower part thereof, with a land surface which is in spaced relation to a corresponding land surface of the other die portion to define a common slot 50 therebetween, as illustrated in FIG. 5. The slot 50 exits or terminates at a pair of die lips including a first die lip 52 associated with the lower part of the body portion 48 and a second die lip 54 associated with the lower part of the body portion 46. The die lip 54 is joined to the body portion 46 through a narrow hinge portion 56 in a conventional manner by means of which the relative spacing of the die lips may be adjusted, such as by differential adjusting bolts 58, FIG. 2.

The die body 25 includes a through passage by means of which a suspension of material or particles to be coated may be applied to the upper end of the slot 50 for movement therethrough and for forming a curtain to fall upon the web being formed on the wire 14. The die 25 differs from conventional extrusion dies in that a continuous flow of the suspension is desired in order to prevent stagnation regions and stratification or separation of particles out of suspension. Preferably, where a particulate starch is carried and delivered to the die, a turbulent flow condition is maintained.

Figure 2:
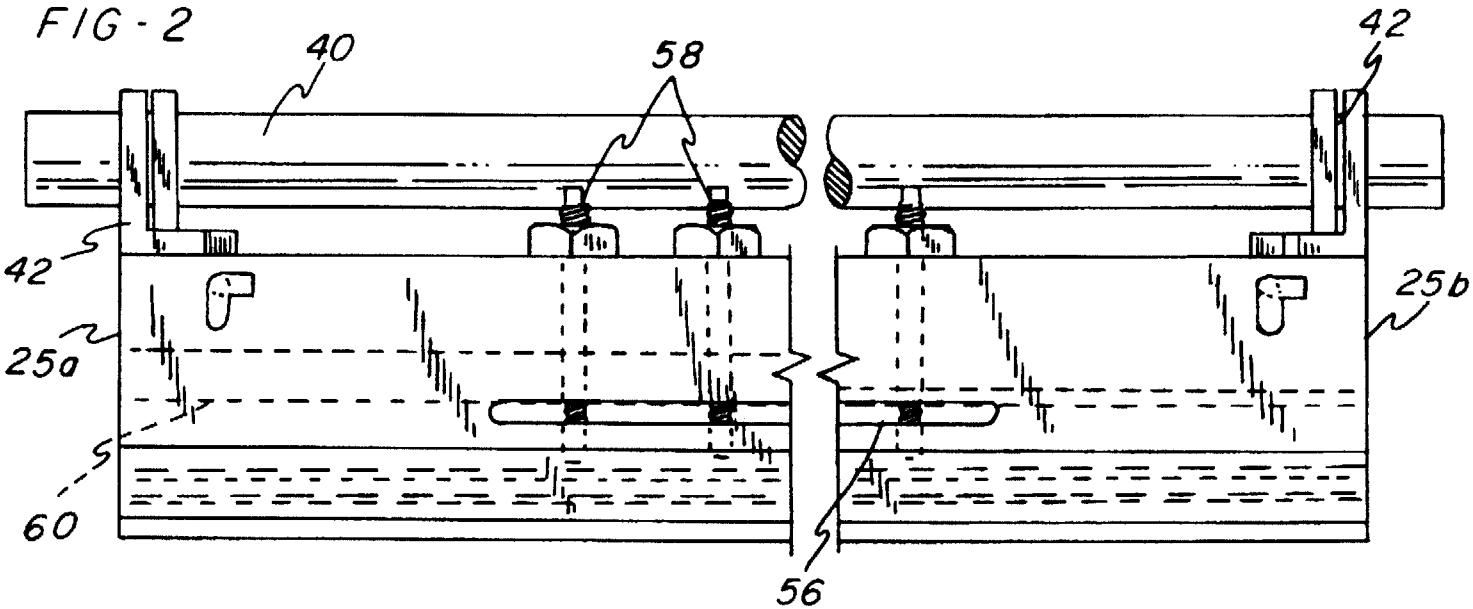
FIG. 2 is a partially broken away side elevational view of a curtain coating die in accordance with this invention.
Figure 3:
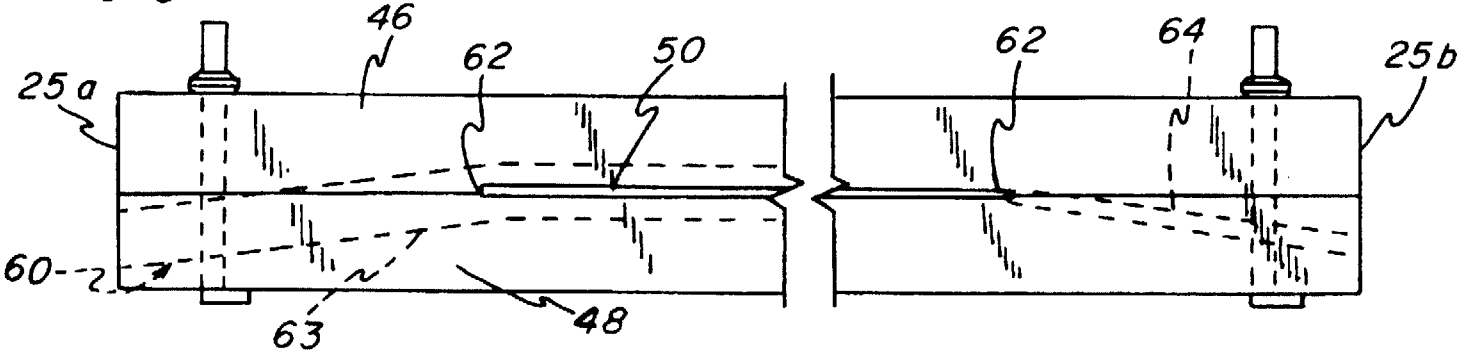
FIG. 3 is a partially broken away bottom view of the die of FIG. 2 showing the die slot and in which the broken lines illustrate the alignment of the feed passageway through the die body.

To this end, a through passage indicated generally at 60 in FIG. 2 extends from the die inlet end 25*a* to the die outlet end 25*b*. Throughout the major length of the die body portions, the passage 60 is evenly divided or bisected by the center line between the die portions, one-half being formed in the die portion 46 and the other half being formed in the die portion 48. However, as shown in FIG. 3, the slot 50 preferably does not extend entirely to the body ends but terminates inwardly at the ends, such as at a termination points 62. The termination points 62 define the effective width of the slot 50 and the width of the curtain 30.

Beginning at the termination points 62, the passageway 60 is angled at portions 63 and 64 (FIG. 3) so as to be brought out entirely within only one of the die body portions. To that end, FIG. 3 illustrates the passageway 60 as being angled into the die body portion 48, at each end. In this manner, fluid connections may be made to the ends of passageway 60 by a threaded coupling at only one of the die body portions, thereby eliminating the need for the conventional end plate as found on extrusion dies.

Further, preferably area or size of the passageway 60 is tapered substantially throughout the length of the slot 50 from a maximum at the inlet end to a minimum at the outlet end. The reduction in cross-sectional area is such that the flow rate therethrough from the inlet end to the outlet end remains substantially constant. In this manner, the proportions of the passageway with respect to the quantity of the material flowing therethrough is maintained, for the purpose of maintaining a turbulent flow control condition within the passageway 60 as material is removed therefrom through the slot 50.

By reference to FIG. 5, it will be seen that the die slot 50 terminates at the pair of opposed die lips 52 and 54. Each die lip is provided with a downwardly depending cut-off portion which provides flat ends 70 and 72, each forming the lower terminus of the die lip. It will also be seen that the lower end 72 of the die lip 52 is extended below that of the die lip 54 so that material flowing through the slot will then flow along an exposed land surface portion 75 associated with the die lip extension 72. The land portion 75 which is exposed below the bottom terminus 70 of the die lip 54 provides a flow control surface on which the curtain flows downwardly and accelerates toward the fourdrinier wire, and in which a surface of the curtain is exposed to surface tension. By offsetting the lower terminus of the die lips one with respect to the other, a short region is formed in which the curtain is constrained only by one surface, thus substantially reducing friction as compared to the condition where the flow is between parallel walls.

The invention also includes a means for keeping the die lips clean and free of accumulated materials. To this end, a pair of conduits 80 and 82 forming cooling flow passages may be made of a suitable heat conductive material and provide for the chilling of the die lips in accordance with refrigerated or cooled liquid flowing through the cooling passages. The conduits are associated with and joined to flat plates 90 and 92 along the outer surfaces of the die lips.

The arrangement permits the die lips to be cooled to a temperature below the dew point temperature, to cause condensation to form on the exterior surfaces of the die lips and the plates 90 and 92, so that these surfaces are prewetted and are resistant to build up of coating materials. Preferably, an air space 93 is provided between the cooling conduits 80 and 82, to assure that the cooling is confined as much as practical to the plates 90 and 92 and to the outer surfaces of the lips, and does not unduly chill the surfaces which form the extrusion slot 50.

Figure 6:
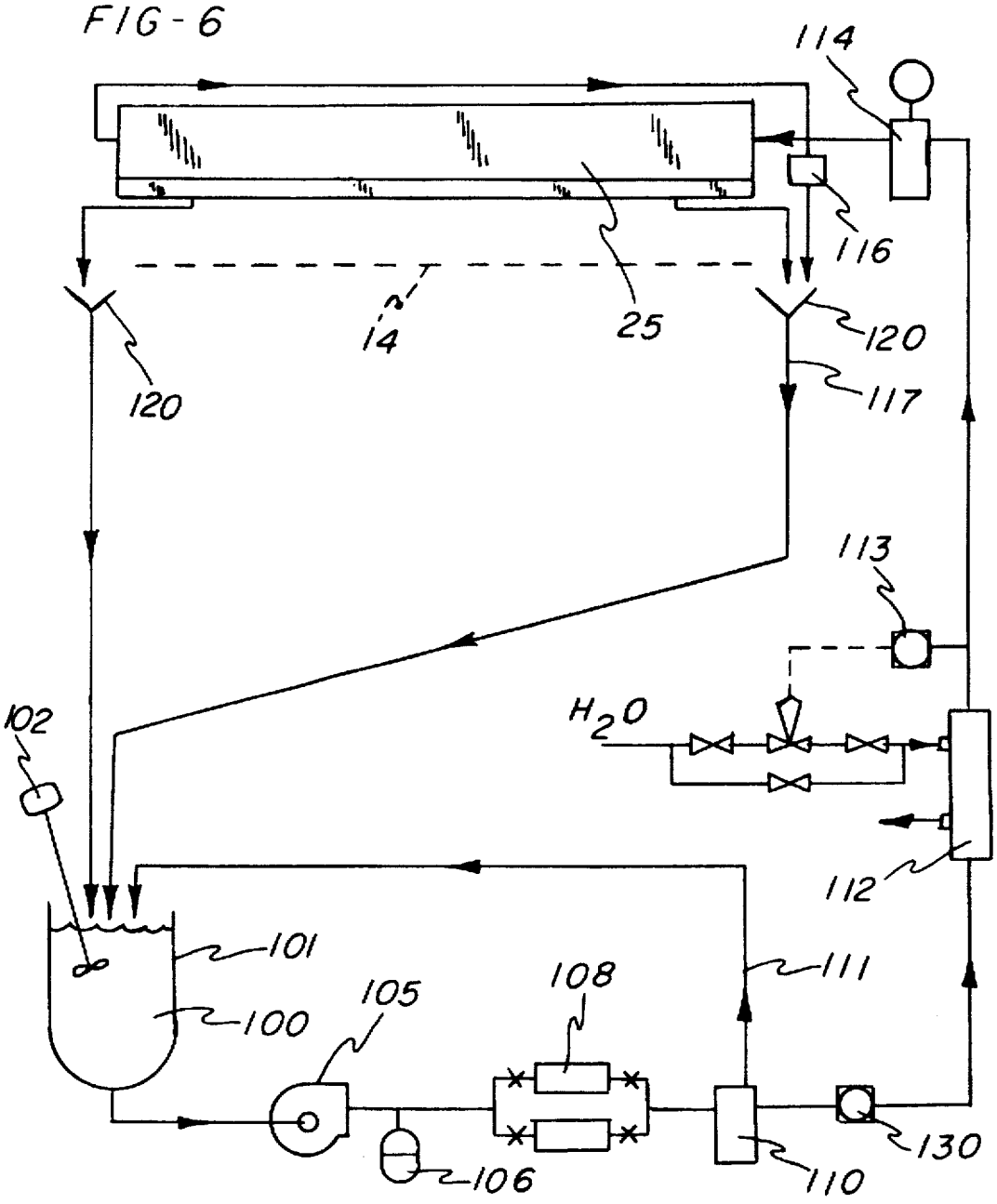
FIG. 6 is a flow diagram of the coating system.

Referring to FIG. 6, a system for operating the die 25 is represented as including a source of starch 100 suspension in a tank 101 which may include a mixer 102 for maintaining the starch in suspension. Suitable makeup lines and level control means for the tank 101 may be included, not shown in FIG. 6.

A variable speed constant displacement pump 105 delivers the suspension 100 at a controlled rate and pressure, and a pulsation chamber 106 may be placed in the line for reducing pulses.

Preferably, one or more filters 108 are in the line to remove larger starch agglomerations and lumps which would interfere with the de-gassing of the suspension.

Preferably, the suspension is subjected to a de-gassing operation through which entrained air, in the form of foam and bubbles, is removed. Generally, it is desirable that no bubble be allowed to remain in the suspension, to be applied to the die body 25, which has a diameter which exceeds the extrusion slot width. A particularly effective deaeration apparatus 110 is that described in the patent of Taylor et al., U.S. Pat. No. 5,149,341 issued Sep. 22, 1992. The air-rich fraction is returned on line 111 to the tank 101.

The deaerated suspension is preferably applied through a hot water exchange-type heater 112 to elevate the temperature of the suspension up to as high as about 150° F., but in any case, to a temperature less than the cooking temperature of the starch. The heat exchanger 112 may have a temperature controller 113 by means of which the flow of heating fluid, such as hot water, may be controlled.

The heated suspension is applied directly to the inlet of the passageway 60, of the die preferably through a final filter 114 to prevent plugging of the die slot. To prevent filter plugging, a vibrating-type pressure filter 114 is used. The vibrating filter also operates to prevent the settling of starch particles out of suspension in the filter. This filter may be a model SS-0736-VIB of Ronningen-Petter, 9151 Saver Road, Portage, Mich. 49081.

As previously described, the passageway 60 extends the length of the die 25, and the bleed taken from the small end 64 of the passageway, at the opposite end of the die is returned through a manual flow control valve 116 to a collection line 117 returning the flow to the tank 100.

It is contemplated that the die slot 50 may have a transverse width greater than the width of the web carried on the wire, 14 as represented by the broken lines. To this end, a suitable external deckle may be applied, as well known in the art, to restrict the width of flow of the curtain. Flow captured by the deckle or outside of the deckled region may similarly be returned to the tank by suitable collectors 120 positioned on each lateral side of the wire, with return lines 121 and 117 to the tank 100.

In the practice of the method of the invention, the following parameters have been found to provide satisfactory applications of a starch suspension to a moving web on a fourdrinier machine with high retention percentages and retention rates which approach or exceed 100 pounds per ton. With a 124" die body for a web or wire about 100" wide, the pump 105 may produce 26 gpm with about 3 gpm flowing back to the tank 101 on line 111 from the bubble eliminator 110.

A flow meter 130 may be inserted to regulate the desired amount of rate of flow of suspension to the die. The manual flow control valve 116 may be adjusted to provide the desired application rate of the curtain from the die lips to the forming web on the wire 14. A die slot of about 0.01" has been found to provide satisfactory service, with a flow rate of about from 0.1 to about 0.25 gallons per minute per linear inch of die slot. In this example, a flow of 0.23 gallons per minute to the inlet end of passageway 60 of the die at about 8 psig, with a bleed rate from the outlet end of the passageway 60 of about 0.2 gallons per minute provides a flow rate through the slot of about 0.23 gallons per minute per inch of slot length.

The lower extended end of the die lip, as measured from surface 70 in FIG. 5, may be spaced from the fourdrinier wire as little as of about ½" to about 14", with spacing in the range of 4" to 8" being preferred. In this example, the exit velocity of the suspension from the slot will be about 1.7 meters per second (334 ft/min.) and, at a 5" height, the landing velocity of the curtain on the web will be about 2.3 meters per second (453 ft/min.). Landing velocities up to 475 ft/min. have been found not to unduly disrupt the integrity of the web on the wire or form a puddle on the wire.

An unexpected and unobvious result of the method of the invention is the fact that the curtain 30 may be applied at a location along the wire in which the table consistency (i.e., the consistency of the fibrous mat on the wire) is as low as about 2%. This allows the designer a substantial range in which to position the die 25 with respect to the length of the table.

In order to verify the retention rates and increases in strength, a series of experiments were run on a laboratory fourdrinier machine having a 24" wide wire and using a headbox deckled to 18 inches. The stock fibers were re-pulped old corrugated cartons (OCC). A converted 36" plastic extruder die, centerfed, and adjusted to a 0.010 inch width slot formed the curtain. The results of a series of controlled tests are set out in the table, divided for convenience into table IA and table IB. In the tables, the following terms are defined:

"BW ADJ" equals basis weight in pounds per thousand square feet of the finished paper. The amount has been adjusted to subtract the specific weight of the starch which was recirculated to the headbox in the white water.

"Starch Sol%" equals the percentage of uncooked starch to water, by weight, of the starch suspension applied to the die.

"Table Cons%" equals the measured consistency of the paper web at particular die positions along the wire prior to the application of the starch suspension.

"Add On #/Ton" represents a calculated weight of starch applied by the die at each test, per ton of paper dry.

"%Starch" equals the measured starch found in a sample of the paper produced in the test as a percentage of the dry weight of the sample.

"Base St #/Ton" equals the weight of starch applied to the same paper sample in terms of pounds per U.S. ton.

"Starch Ret%" equals a calculated percentage of starch retained versus total amount of starch applied.

CFC is Concora Flat Crush, according to Tappi standard T-824.

CMT is Concora Medium Test, according to Tappi standard T-811.

TABLE IA

| Test | BW ADJ | Starch Sol % | Table Cons % | Add On #/ton | % Starch | Base St #/ton | Starch Ret % | CFC | CMT |
|---|---|---|---|---|---|---|---|---|---|
| 1A | 23.0 | NS | | 0.0 | 0.2 | 0 | | 53.2 | 41.8 |
| 1 | 22.4 | 7.0 | 5.0 | 121.7 | 5.2 | 0 | 82 | 65.3 | 48.5 |
| 2 | 23.0 | 6.0 | 6.8 | 101.7 | 5.7 | 0 | 108 | 63.7 | 47.6 |
| 3 | 23.3 | 6.0 | 2.6 | 101.4 | 5.0 | 1 | 94 | 67.9 | 54.1 |
| 4 | 22.6 | 6.0 | 6.8 | 103.3 | 5.9 | 1 | 109 | 36.0 | 48.5 |
| 5 | 23.3 | 3.8 | 2.6 | 65.6 | 2.4 | 1 | 66 | 65.5 | 50.5 |

TABLE IA-continued

| Test | BW ADJ | Starch Sol % | Table Cons % | Add On #/ton | % Starch | Base St #/ton | Starch Ret % | CFC | CMT |
|---|---|---|---|---|---|---|---|---|---|
| 6 | 23.3 | 3.8 | 6.8 | 65.0 | 3.1 | 1 | 88 | 62.3 | 47.0 |
| 7 | 23.6 | 3.8 | 2.6 | 64.2 | 3.0 | 2 | 84 | 66.1 | 51.5 |
| 7A | 23.2 | NS | | 0.0 | 0.3 | 2 | | 54.5 | 42.9 |
| 8 | 23.6 | 4.8 | 5.6 | 80.1 | 4.2 | 2 | 97 | 66.3 | 49.7 |
| 9 | 23.6 | 4.8 | 8.9 | 80.3 | 4.0 | 2 | 92 | 64.7 | 47.8 |
| 10 | 23.2 | 4.8 | 5.6 | 81.3 | 4.0 | 3 | 90 | 64.8 | 51.5 |
| 11 | 23.6 | 4.8 | 1.9 | 80.7 | 3.3 | 3 | 73 | 68.1 | 54.7 |
| 12 | 23.0 | 4.8 | 5.6 | 82.2 | 4.1 | 4 | 90 | 64.5 | 49.2 |
| 13 | 23.9 | 1.7 | 5.6 | 28.8 | 1.6 | 4 | 83 | 61.8 | 49.4 |
| 13A | 23.5 | NS | | 0.0 | 0.4 | 4 | | 58.0 | 43.9 |
| 14A | 38.8 | NS | | 0.0 | 0.6 | 8 | | 88.6 | 59.0 |
| 14 | 38.6 | 8.8 | 5 | 121.7 | 6.7 | 6 | 102 | 106.3 | 71.9 |
| 15 | 38.8 | 7.7 | 7.2 | 106.8 | 5.9 | 9 | 98 | 108.7 | 70.4 |
| 16 | 39.6 | 7.7 | 2.9 | 103.7 | 6.8 | 11 | 117 | 113.4 | 76.0 |
| 17 | 40.3 | 7.8 | 7.2 | 103.9 | 5.0 | 13 | 80 | 116.5 | 66.2 |
| 18 | 39.6 | 3.8 | 2.8 | 53.7 | 3.1 | 15 | 90 | 116.7 | 75.4 |

TABLE IB

| Test | BW ADJ | Starch Sol % | Table Cons % | Add On #/ton | % Starch | Base St #/ton | Starch Ret % | CFC | CMT |
|---|---|---|---|---|---|---|---|---|---|
| 19 | 39.8 | 3.8 | 7.2 | 53.4 | 2.9 | 17 | 78 | 104.2 | 64.5 |
| 20 | 39.7 | 3.8 | 2.8 | 53.7 | 2.9 | 18 | 76 | 108.2 | 71.1 |
| 20A | 39.5 | NS | | 0.0 | 1.1 | 18 | | 97.9 | 64.2 |
| 21 | 39.6 | 5.6 | 5 | 78.2 | 4.5 | 17 | 88 | 110.2 | 70.4 |
| 22 | 39.8 | 5.6 | 8.4 | 78.0 | 4.0 | 17 | 43 | 106.2 | 69.7 |
| 23 | 39.4 | 5.6 | 5.0 | 78.7 | 4.3 | 16 | 84 | 108.5 | 73.9 |
| 24 | 39.9 | 5.6 | 2.5 | 77.7 | 4.2 | 15 | 84 | 115.2 | 81.4 |
| 25 | 40.2 | 5.6 | 5 | 76.7 | 4.8 | 14 | 102 | 109.6 | 71.0 |
| 26 | 39.9 | 2.0 | 5.0 | 28.5 | 2.3 | 13 | 102 | 103.6 | 69.2 |
| 26A | 40.2 | NS | | 0.0 | 0.8 | 12 | | 98.3 | 62.3 |
| 27A | 33.4 | NS | | 0.0 | 0.9 | 14 | | 81.0 | 60.5 |
| 27 | 32.6 | 7.0 | 2.7 | 98.3 | 4.7 | 13 | 78 | 103.9 | 88.5 |
| 28 | 33.0 | 7.0 | 7.2 | 97.3 | 4.5 | 15 | 73 | 101.1 | 72.5 |
| 29 | 34.0 | 7.0 | 2.7 | 94.9 | 4.1 | 15 | 66 | 104.0 | 90.2 |
| 30 | 34.1 | 7.0 | 5.0 | 94.7 | 4.1 | 15 | 66 | 102.2 | 78.3 |
| 31 | 32.2 | 4.1 | 5.0 | 59.8 | 3.4 | 15 | 82 | 91.4 | 75.9 |
| 32 | 32.1 | 4.1 | 5.0 | 60.1 | 3.6 | 15 | 88 | 89.1 | 73.5 |
| 33 | 31.2 | 4.1 | 5.0 | 61.6 | 3.7 | 15 | 89 | 91.0 | 69.5 |
| 34 | 32.5 | 2.5 | 7.2 | 35.4 | 2.6 | 15 | 96 | 91.1 | 68.8 |
| 35 | 31.8 | 2.5 | 2.7 | 36.2 | 2.3 | 15 | 74 | 96.2 | 76.4 |
| 36 | 32.5 | 2.5 | 7.2 | 35.4 | 2.4 | 16 | 85 | 88.1 | 68.7 |
| 36A | 33.1 | NS | | 0.0 | 1.0 | 16 | | 85.5 | 62.1 |

The tests results set out in table IA and IB represent three series of runs, each series at a specific wire speed and using various consistencies of the uncooked starch suspension, and with the die was located at selected positions defined by table consistencies from a high of 8.44 to a low of 1.9. For each of these tests, samples were taken, the percentage of starch in the sample was measured, the weight of the retained starch was calculated (in pounds per ton), and the strength of the dried paper was tested, defined as "CMT" and "CFC" respectively, according to conventional Tappi standards T-811 and T-824.

In all tests, the starch suspension was applied at ambient temperature, that is, without heating. The die lips were positioned about 5" above the wire, and operating conditions were established such that the flow rate through the die slot was approximately 0.2 gallons per minute per linear inch.

Test numbers 1 through 13A were operated at a wire speed of 919 feet per minute. Consistencies of starch to the die were varied from a minimum of 1.7% (test no. 13) to a maximum of 7% (test no. 1). In the same series of tests 1–13A the die was moved with respect to the wire from a position of low sheet (table) consistency of 1.9 (test no. 11) to a higher sheet consistency of 8.9 (test no. 9). Throughout this first group of tests, the measured starch retention in the finished paper fibers went from a minimum of 66% up to about 100%. The figures under "Starch Ret %" which exceed 100% are the result of acceptable instrument and procedures errors in including errors in measuring the actual amount of starch in the finished paper sheet. Any calculated percentage in excess of 100 must be ignored.

In the first group of tests 1–13A, three base lines were established, the first 1A at the beginning of tests in which it was noted that a small residual amount of starch appeared in the stock suspension. This small amount of 0.2% may be attributed to a finding of unwashed starch molecules making up the OCC stock in the test sheet. The amount of starch in the suspension increased during the tests by reason of starch being returned to the stock beater chest in the white water loop.

A second series of tests nos. 14–26A were run immediately following the first series, at a wire speed of 657 feet per minute. Again, three base lines were established tests, i.e., tests 14A, 20A and 26A, and the die was moved from table positions to low sheet consistency of 2.5 (test no. 24) to a high sheet consistency of 8.4 (test no. 22). Starch consistencies of as high as 7.7% and as low as 2% were applied and the results were calculated based upon an analysis of the finished paper. The increases in CFC and CMT, as well as retention rates, were comparable to those achieved in tests 1–13A.

A third set of tests were run, numbers 27 through 36, at a wire speed of 778 feet per minute. Two base line tests were taken nos. 27A and 36A. At this time, the base starch in the beater chest had stabilized at about 15%. Nevertheless, the retention rates and the increases in CFC and CMT remained substantially consistent with those of the preceding tests.

Consistently, superior results were obtained when the die was positioned at low table consistency positions down to about 2%. Contrary to expectations, some of the highest strength tests were found when the starch was added at a low table consistency below 3%. This is believed to be due to a surprisingly high percentage of starch retention accompanied by substantial, if not complete, starch penetration and dispersion through the thickness of the web.

The tests as set out in the table indicate that about 80 pounds of starch per ton provide a 27% average increase in CFC and a 34% average increase in CMT in the finished paper. These figures compare favorably with those achieved using a conventional sizing press. The mean retention value was 86%.

An examination of the sheets produced in the tests identified in the table shows that the applied starch appeared to be fully solubilized and hydrolyzed in the sheet. No evidence was observed of the presence of unhydrolyzed starch particles. Therefore, it appears that the available starch has been fully utilized and its potential benefits have been realized, as identified by the increased strengths which have been observed. This complete utilization is believed to be attributed, at least in part, to the fact that the uncooked starch particles bulk and absorb approximately their own weight in water, which is not removed on the paper machine and likewise is carried as molecular water through the convention press section and into the dryer section where that water content, as well as the remaining percentage of water in the sheet, is sufficient to provide full activation of the starch in the finished sheet.

The results of these tests indicates that excellent, if not superior, results can be obtained by applying, by means of a curtain, a suspension of uncooked starch and water to a web at the point at which a substantial rate of drainage is occurring, as low as about 2% table sheet consistency of the web on the wire, without unduly disrupting or disturbing the web and while achieving retention rates in the web in excess of 75%. Common pearl starch is retained and the use of more costly cationic starch is not required.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. The method of applying a starch to a forming web of paper fiber through an elongated downwardly opening slot in a die positioned transversely to the direction of movement of such web of paper fibers on a wire of a paper making machine, comprising the steps of:

forming an unstable suspension of particulate uncooked starch in water at a consistency of between about 2% to 10% solids to liquid content, degassing said suspension to remove from said suspension air bubbles of a size that exceed the width of said die slot, heating said degassed suspension to a temperature of less than about 150° F. to prevent cooking of the starched particles in suspension, applying said degassed and heated suspension to the inlet of said die and causing said heated and degassed suspension to flow out of said die slot as a free-falling curtain and to impact an exposed surface of said web at a location on said wire at a web consistency of between about 2 to about 10% prior to the entry of such web into a press section and maintaining a condition of flow of said heated and degassed suspension in said die to prevent settling of starch particles out of such suspension and, controlling the impact velocity of said curtain at a rate sufficiently low to prevent distortion of said web at impact.

2. The method of claim 1 in which said free-falling curtain displaces said web by displacement of at least a portion of the liquid content of said web by the liquid content of said applied suspension.

3. The method of claim 1 in which said impact velocity is sufficiently high to prevent curtain deflection by air entrained with the web which could cause skips in the uniformity of the applied starch.

4. The method of claim 1 further comprises the step of directing said suspension through a vibrating pressure filter following said heating step and prior to said applying step.

5. A method of operating a die having a downwardly opening die slot to apply a starch particle impregnation to paper, during the formation of the paper on a wire of a paper making machine, comprising the steps of:

forming an unstable suspension of uncooked starch particles and water at a consistency of between about 2% and 10% starch to water by weight, degassing said suspension to remove therefrom air bubbles of a size that exceed the width of the slot in said die, and applying said degassed suspension to said die under pressure for flow through said die slot onto an exposed moving surface of a draining web of paper fibers on such exposed surface.

6. The method of claim 5 further comprising the step of passing said suspension through a vibrating pressure filter prior to said applying step.

7. The method of claim 5 in which said suspension is heated to an elevated temperature less than the cooking temperature of such starch particles prior to said applying step.

8. The method of claim 7 in which said temperature is about 150° F.

9. The method of claim 5 in which said step of applying said suspension includes the step of positioning a wind curtain upstream of said falling curtain.

10. The method of operating a curtain coating die for applying a coating curtain of an uncooked starch suspension at a consistency of between about 2% to 10% solids-to-liquid content to an exposed surface of a moving wet web of paper at the forming section of a paper machine, in which said curtain coating die has a pair of opposed die lips defining a downwardly opening slot therebetween, comprising the steps of applying a starch suspension to said coating die at an elevated temperature which is greater than ambient but less than the cooking temperature of starch in said suspension, chilling said die lips to a temperature below the dew point temperature to cause condensation to form thereon and wet the exterior surfaces thereof at regions adjacent said slot, and flowing said suspension at said elevated temperature through said slot and onto said web exposed surface.

11. The method of claim 1 in which said newly formed web is on a wire of a fourdrinier machine, and in which said curtain impacts said web at a position where said web has a table consistency of between about 2% and 3%.

12. The method of claim 5 in which said curtain is applied to said draining web at a region in which said web has a consistency of between about 2% and 3%.

13. The method of operating a die having a downwardly opening elongated die slot to apply a starch particle impregnation to the exposed surface of a draining web of paper on a forming wire of a paper making machine in which said die is positioned above and transversely of the direction of travel of such draining web of paper, comprising the steps of:

providing an unstable suspension of uncooked starch particles and water at a consistency of about 2% to 10% solids-to-liquid content, applying said suspension under pressure to said die and preventing the settling of said suspension while in said die, and positioning said die to deliver said suspension through the die slot as a freefalling curtain onto said exposed surface of said draining web at a position where said web has drained to a consistency of between about 2 to 10%.

14. The method of claim 13 in which said die is positioned to apply said curtain to said draining web at a position where said web of paper has drained to a consistency of about 2–3%.

* * * * *